US006183886B1

(12) United States Patent
Chen et al.

(10) Patent No.: US 6,183,886 B1
(45) Date of Patent: Feb. 6, 2001

(54) TIN COATINGS INCORPORATING SELECTED ELEMENTAL ADDITIONS TO REDUCE DISCOLORATION

(75) Inventors: Szuchain Chen, Orange; Julius Fister, Hamden; Christopher Laurello, Guilford, all of CT (US)

(73) Assignee: Olin Corporation, New Haven, CT (US)

( * ) Notice: Under 35 U.S.C. 154(b), the term of this patent shall be extended for 0 days.

(21) Appl. No.: 09/213,545

(22) Filed: Dec. 17, 1998

Related U.S. Application Data

(63) Continuation-in-part of application No. 09/054,899, filed on Apr. 3, 1998.

(51) Int. Cl.[7] ..... H01R 13/03; B32B 15/20; C25D 5/50

(52) U.S. Cl. ..... 428/647; 428/658; 428/929; 439/886; 148/537; 205/177; 205/226; 427/123; 427/406

(58) Field of Search ..... 428/646, 647, 428/658, 674, 929, 926; 427/123, 406, 383.7; 205/176, 177, 225, 226; 439/886; 148/537

(56) References Cited

U.S. PATENT DOCUMENTS

| | | | | |
|---|---|---|---|---|
| 3,767,391 | | 10/1973 | Tucillo | 75/134 C |
| 3,940,303 | | 2/1976 | Caule | 156/316 |
| 4,091,173 | * | 5/1978 | Hage | 85/41 |
| 4,113,475 | | 9/1978 | Smith | 75/159 |
| 4,204,883 | | 5/1980 | Smith | 148/2 |
| 4,255,191 | | 3/1981 | Kropp | 75/134 N |
| 4,376,154 | * | 3/1983 | Nakatsugawa | 428/607 |
| 4,468,293 | | 8/1984 | Polan et al. | 204/27 |
| 4,490,218 | | 12/1984 | Kadija | 204/13 |
| 4,493,736 | | 1/1985 | Adams | 148/2 |
| 4,663,245 | | 5/1987 | Yoshida | 428/632 |
| 4,917,967 | | 4/1990 | Cupolo | 428/669 |
| 5,028,492 | | 7/1991 | Guenin | 428/614 |
| 5,300,158 | | 4/1994 | Chen | 148/258 |
| 5,332,486 | | 7/1994 | DiFranco | 205/50 |
| 5,343,073 | | 8/1994 | Parthasarathi et al. | 257/666 |
| 5,759,379 | * | 6/1998 | Cavallotti et al. | 205/177 |
| 5,780,172 | | 7/1998 | Fister et al. | 428/647 |

FOREIGN PATENT DOCUMENTS

| | | | |
|---|---|---|---|
| 1-259195 | * | 10/1989 | (JP) . |
| 2-145794 | * | 6/1990 | (JP) . |
| 3-239353 | | 10/1991 | (JP) . |

OTHER PUBLICATIONS

*An Examination of Oxide Films on Tin and Tinplate*, by S.C. Britton and K. Bright; The Tin Research Institute, Oct., 1957, pp. 163–168.

* cited by examiner

*Primary Examiner*—John J. Zimmerman
(74) *Attorney, Agent, or Firm*—Gregory S. Rosenblatt; Wiggin & Dana

(57) ABSTRACT

A tin coated electrical or electronic component has enhanced resistance to oxidation and tarnishing as well a smaller increase in contact resistance when exposed to elevated temperatures. These benefits are achieved by depositing a relatively thin, on the order of 5–50 angstroms thick, layer of zinc on the tin coating prior to heating. A subsequent step of heating the sample to a temperature and time effective to convert all free tin to an intermetallic imparts the additional advantage of reducing the coefficient of friction.

7 Claims, 2 Drawing Sheets

TIN COATINGS INCORPORATING SELECTED ELEMENTAL ADDITIONS TO REDUCE DISCOLORATION

CROSS-REFERENCE TO RELATED PATENT APPLICATION

This patent application is a continuation in part of U.S. patent application Ser. No. 09/054,899 entitled "Tin Coatings Incorporating Selected Elemental Additions to Reduce Discoloration" by Chen et al., that was filed on Apr. 3, 1998. The Ser. No. 09/054,899 application is incorporated by reference in its entirety herein.

BACKGROUND OF THE INVENTION

1. Field of the Invention

This invention relates to a method to enhance the elevated temperature performance of tin coated electrical and electronic articles. More particularly, a zinc layer is deposited on the tin coating thereby reducing the contact resistance of articles exposed to elevated temperatures for extended periods of times, for example, 150° C. for seven days or for 125° C. for 1000 hours.

2. Background of the Invention

Copper and copper alloy substrates are formed into articles for use as electrical and electronic components, such as electrical connectors and leadframes. Copper and copper alloys readily oxidize when exposed to oxygen containing atmospheres and readily tarnish when exposed to sulfur containing atmospheres. Both oxidation and tarnish are exacerbated at elevated temperatures, defined herein as temperatures above about 125° C. Since air contains oxygen as a major constituent and sulfur as a common pollutant, under the hood automotive connectors and appliance connectors are exposed to oxidizing and tarnishing environments.

The copper or copper alloy substrate may be coated with a layer of tin to inhibit surfaces of the copper or copper alloy article from oxidizing or tarnishing. A tarnish-free and oxide-free surface has lower electrical contact resistance and better solderability than an oxidized or tarnished surface.

When exposed to an oxidizing atmosphere at elevated temperatures, tin coatings are prone to oxidation. The oxide film is typically only about 50–200 Angstroms in thickness, but the surface oxide imparts the article with a yellow color that many consumers consider unacceptable. If sufficiently thick, the oxide layer may increase the contact resistance of the tin coated article.

A publication entitled, "An Examination of Oxide Films on Tin and Tin Plate", by S. C. Britton and K. Bright discloses that alloying small amounts, on the order of 0.1%, of phosphorous, indium or zinc with tin either prevents or reduces the formation of tin oxide when heated to 210° C. for 18 hours.

Japanese Kokai No. 3 (1991)-239,353 published Oct. 24, 1991, discloses a copper leadframe for semiconductor devices having a zinc layer disposed between the copper substrate and a tin-base tin/lead solder coat. The zinc layer is disclosed to be a barrier layer that reduces interdiffusion between the tin and the copper leading to enhanced solder wettability when heated.

Other barrier layers disposed between a copper alloy substrate and a tin coating layer are disclosed in U.S. Pat. No. 5,780,172 by Fister et al. that is incorporated by reference in its entirety herein. The patent discloses copper/nickel barrier layers in the form of both a copper base alloy as multiple layers. The inclusion of a zinc layer in the barrier is also disclosed.

An article, such as a copper or copper-base alloy electrical connector or electronic component, may coated with a tin or tin-base coating (The term "base" is intended to convey that the alloy contains at least 50%, by weight, of the specified element. Tin or tin base coatings will be referred to herein as tin coatings. All percentages are in weight percent unless otherwise specified.) by any one of a number of conventional processes such as electroplating, hot dipping, electroless chemical deposition, vapor deposition or cladding.

Electroplating electrolytically deposits tin from a tin ion containing electrolyte on to a cathodically charged article. Examples of such baths include tin fluoborate, tin methanesulfonic acid, tin sulfate and stannate. One exemplary electrolyte contains between 10 g/l and 50 g/l of tin and between 30 g/l and 70 g/l of sulfuric acid. This bath is typically acidic and operated at a nominal temperature of 20–40° C. at a current density of about 30 amps per square foot. The bath will deposit about 50 microinches of tin in 1 minute.

The tin coating layer may be bright or matte dependent on the electroplating conditions. A bright finish may be achieved by adding an organic material, for example, polyethylene glycol, to the tin bath. The addition of such an organic material produces a tin coating with a smooth, hard surface and high reflectivity.

Reflectivity may be evaluated by the "ruler test". A conventional ruler is extended vertically from a horizontally lying sample. The highest number that can be clearly discerned in the tin plate reflection is deemed the reflectivity.

A matte finish is a semi-bright, satin, finish that is typically thicker than the bright finish. While cosmetically less appealing, matte coatings tend to have a longer service life and are typically used in heavy-duty applications.

The tin coating may also be deposited by a HALT (hot air level tin) process. The article is immersed in a molten tin bath and wet by the tin. When the article is withdrawn from the molten tin bath, jets of high velocity hot air are directed across major surfaces of the article. The hot air levels the tin coating at a desired thickness such as between 40 to 400 microinches thick.

In place of the HALT process, a mechanical wipe process may be. An article is immersed in a molten tin bath and, upon withdrawal from the bath, the article is physically wiped such as with steel rods, glass rods or wire brushes. The thickness of the tin layer is a function of how much tin is wiped from the surface. The thickness of the tin coating is typically between about 20–80 microinches, with a preferred thickness of approximately 25–50 microinches.

Notwithstanding the method of tin deposition, most electrical and electronic articles are coated with between 15 and 200 microinches of tin.

A tin-lead solder coating may also be deposited on the article by any of the above methods. Typical solders have from 5% to 95% tin and the balance is lead. Preferably, the solder coat is from 25% to 75% tin and the remainder lead. Two common solders are 60%/40% Sn/Pb and 63%/37% Sn/Pb.

There remains, however, a need for a method to impart tin coated articles that will be exposed to oxidizing and tarnishing atmospheres at elevated temperatures with enhanced solderability and reflectivity while reducing an increase in contact resistance following exposure to elevated temperatures.

BRIEF SUMMARY OF THE INVENTION

Accordingly, it is an object of the invention to provide a method for manufacturing an article useful for electrical and electronic applications where the contact resistance does not substantially increase following heating to about 150° C. for an extended period of time. It is a further object of the invention that the article has a low contact force.

It is a feature of the invention that the article is formed by coating a copper or copper alloy substrate with a tin base layer and then coating the tin base layer with a thin (on the order of 5–100 angstroms) layer of zinc. It is another feature of the invention that following tin reflow, the article has high reflectivity and good solder wettability.

Among the advantages of the invention are that the article has a low, less than 10 milliohms, contact resistance following heating to 150° C. for in excess of seven days.

It is a further advantage that when all tin is converted to a tin-containing intermetallic, and that intermetallic is substantially metal oxide free, the coefficient of friction is significantly reduced.

In accordance with the invention, there is provided a method for enhancing the tarnish resistance of an article having a tin or tin base alloy layer coating a substrate by coating the tin base alloy layer with a zinc containing layer that has a thickness in excess for 5 angstroms. In addition, there is provided an article having electrical or electronic applications. The article has a copper or copper base alloy substrate with a tin containing layer overlying the substrate and a zinc containing layer overlying the tin containing layer. The contact resistance of this article is less than 10 milliohms following heating in air at a temperature of 150° C. for at least seven days.

The above stated objects, features and advantages will become more apparent from the specification and drawings that follow.

DETAILED DESCRIPTION OF THE INVENTION

Figure 1:
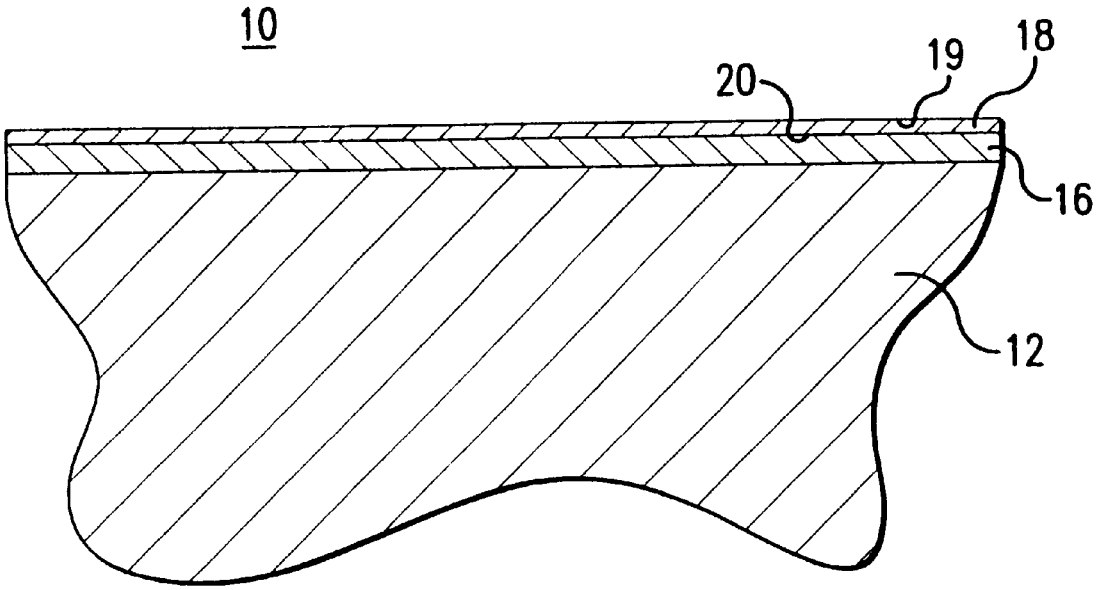
FIG. 1 illustrates in cross-sectional representation a composite substrate in accordance with one embodiment of the present invention.

In accordance with a first embodiment of the invention, a method to reduce elevated temperature oxidation of a tin coating layer includes adding an anti-tarnish agent, for example zinc, indium, phosphorous or mixtures thereof, to the tin coating. The present invention also describes a composite coating of tin and an anti-tarnish agent.

During the formation of the tin coating on an article, the anti-tarnish agent may be added to a molten tin bath and alloyed with the tin. The combination of tin and the anti-tarnish agent form a composite layer that may be deposited on a leadframe. The anti-tarnish agent is introduced into the tin matrix and therefore will not chip, peel or erode off the tin.

The molten tin bath used to produce this composite layer is suitably at least 50% by weight tin with not more than 50% by weight other materials including the anti-tarnish agent and typically 99% to 99.99% tin by weight with 1% to 0.01% by weight of any compound that dissolves in molten tin and is effective to provide tarnish resistance. Preferred are zinc, indium, phosphorous and mixtures thereof.

An article, such as a strip of material, leadframe, electrical connector or substrate, can be immersed in the molten bath having any temperature effective to melt the tin/anti-tarnish agent composition. Preferably, the bath temperature is between 235° C. and 340° C. The immersion time is a period of time effective for the molten material to coat the article, which is typically between 1 and 30 seconds. After a sufficient period of time has elapsed, the article can be removed from the bath and be further processed.

The processing can be any series of steps that produces a desired coating thickness on the article. For example, the mechanical wipe process or the HALT process, as described above, are two processes that can be used to produce a desired coating.

In yet another embodiment, a tin-containing paste or slurry is formed by mixing a tin or tin alloy particulate (nominally the particulate is from 100 angstroms to 10 microns in diameter), a particulate containing the anti-tarnish agent, such as zinc powder and a vehicle such as an organic or water-based carrier. Optionally, an appropriate flux is also included. The paste or slurry is screened onto a copper or copper alloy substrate and then heated to a temperature effective to melt the tin to form the desired tin coating.

Alternatively, the anti-tarnish agent may be added to the tin after the tin coating has been deposited on an article. This subsequent addition reduces effects of oxidation, which is typically visible as a yellowing of the tin coating. This additional treatment could be exposing the tin coating to an anti-tarnish agent, then rapidly heating the surface of the tin coating exposed to the anti-tarnish agent thereby reflowing the surface of the tin coating and alloying the agent into the tin coating. This reflow temperature can typically range from 235° C. to 450° C. for a tin coating. When the coating is a solder coat, such as 60%/40% Sn/Pb, a suitable reflow temperature ranges from 195° to 350° C.

One method of deposition of the anti-tarnish coating is by immersing the article in a chemical solution containing the anti-tarnish agent for a period of time effective to coat the article with the chemical solution. Deposition may be either with or without the addition of electrical current. Upon removing of the article from the chemical solution, a residual layer of chemical will remain on the article.

A preferred concentration of anti-tarnish agent on the article is between 0.01% and 1% by weight. The thickness of the anti-tarnish agent layer, when applied non-electrolytically, is between 5 Å and 2000 Å, preferably between 15 Å and 500 Å and most preferred between 25 Å and 200 Å. When applied electrolytically, the thickness of the anti-tarnish agent is in excess of 5 angstroms and is preferably between about 5 and 100 angstroms. Most preferably, the electrolytically deposited anti-tarnish agent has a thickness of between 5 and 50 angstroms.

The article can then be heated to a temperature sufficient to melt the surface of the tin coating i.e., its reflow temperature. Heating is by any suitable method, such as in a hydrocarbon type reducing atmosphere; in some other suitable atmosphere such as air, nitrogen or other inert gas; an induction furnace; infrared heating; laser; plasma; or immersion in hot oil. Upon heating the article past this temperature, the residual chemical is incorporated into the matrix of the tin coating. Typically, the entire tin coating is reflowed thereby causing the residual chemical to be diffused into the tin coating. However, any portion of the tin coating may be heated to the reflow temperature thereby diffusing any portion of the residual chemical into the tin coating.

The reflowed layer will typically have a higher concentration of residual chemical at an exterior surface of the tin coating than at the interface between the tin coating and the substrate. This gradient is a result of the residual chemical being on the outer surface of the tin coating at the time of reflow. The reflow process causes the residual chemical to be incorporated into the tin matrix, but the tin layer, after reflow, does not necessarily have a uniform concentration of residual chemical.

The thickness of the reflowed layer is typically greater than the thickness of the diffused residual chemical layer since the reflow process causes the residual chemical to alloy with a portion of the tin coating to form the reflow layer. The reflow layer can be as thick as the combined thickness of the residual layer and the tin coating.

Zinc and indium anti-tarnish layers are particularly amenable to deposition onto the tin coating layer by electodeposition. An exemplary electrolyte to deposit a zinc layer contains 0.1 to 200 g/l of zinc chloride in an aqueous solution having a pH between 1 and 5. An electrolyte to deposit an indium layer contains 0.1 to 200 g/l of indium in an aqueous solution having a pH between 1 and 5.

In another embodiment of the invention, an anode having tin and an anti-tarnish agent is placed in an electrolyte bath solution with a cathode. A composite coating of the tin and the anti-tarnish agent is plated to the cathode. An anode having 90% to 99.98% by weight tin and 10% to 0.02% by weight zinc is one example of an anode. A suitable electrolyte bath for use with the composite anode may have 10 g/l to 50 g/l by weight zinc as zinc sulfate salt or any other soluble zinc salt and 10 g/l to 50 g/l tin in a tin sulfate bath.

The cathode may be, for example, a strip or article that has a negative electrical charge in relation to that of the anode and as a result will receive a deposition of approximately the same compositions as the anode. Conventional tin anodes are replaced with anodes containing tin that is alloyed with zinc, indium, or another desired material. During the plating process, the element(s) added to the tin enter the tin bath and plate onto the strip or article, causing the formation of a tin coating doped with the desired elements on the article. Electrical current is applied to the electrolyte bath by a constant current source. The applied current is preferably a constant d.c. current, having a magnitude typically between 20 and 60 Amps/square foot. The dwell time for the anode and cathode in the electrolyte bath is typically between 20 and 100 seconds. Appropriate complexing agents may be added to the bath to ensure that the tin and the additional element(s) electroplate in the preferred composition(s).

In another embodiment, tin coated strips or articles can also be made using any vapor deposition or chemical deposition methods. In these methods, the desired tin alloy, containing for example indium, zinc or phosphorous, can be made by depositing from a tin alloy of the preferred composition or by introducing a gaseous mixture of tin and the preferred metal species into a chemical vapor deposition chamber.

In still another embodiment, thin films of chromium and zinc are plated to a tin coating to prevent oxidation of the tin coating. This film of zinc and chromium is deposited on a tin coating by immersing an article with a tin coating into a bath containing zinc and chromium.

FIG. 1 illustrates in cross-sectional representation an article 10 formed in accordance with the processes of the invention. The article 10 may be a strip to be formed into an article or an article, such as an electrical or electronic component and is preferably an electrical connector. The article 10 has a substrate 12, preferably formed from copper or copper base alloy and a tin coating 16. External, relative to the substrate 12, of the tin coating 16 is an anti-tarnish coating 18. Preferably, the anti-tarnish coating 18 is alloyed to the tin coating 16 as a result of reflowing. The anti-tarnish layer may include anti-tarnish agents such as zinc, indium, phosphorous or alloys or mixtures thereof. The anti-tarnish layer 18 preferably has a higher concentration of anti-tarnish agents at a first surface 19 than at the interface 20 with the tin coating 20. This increased concentration at the first surface 19 is a result of the reflow process that causes the anti-tarnish agent that was on the surface of the tin coating 16 to be diffused into the tin coating. This reflowing does not homogeneously mix the tin and the anti-tarnish agents, but rather results in a concentration gradient from the first surface 19 to the second surface 20.

Figure 2:
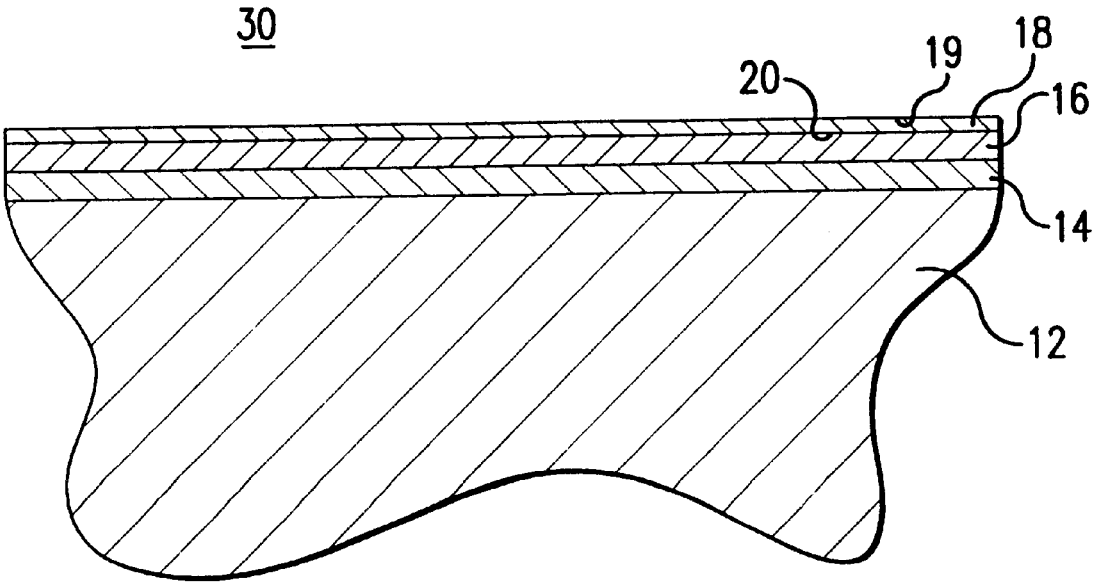
FIG. 2 illustrates in cross-sectional representation a composite substrate in accordance with another embodiment of the present invention.

FIG. 2 illustrates in cross-sectional representation an article 30 that is similar to the article 10 of FIG. 1 except that a barrier layer 14 is disposed between the substrate 12 and the tin coating 16. The barrier layer 14 reduces the rate of interdiffusion between the substrate 12 and the tin coating 16. The barrier layer 14 may be applied to either the entire substrate 12 or any portion thereof, by any suitable means including hot dipping, cladding or electroplating.

The barrier layer 14 may include iron, cobalt, nickel, copper, tin or alloys or mixtures thereof. One example is a copper nickel alloy containing from 10% to 70% of nickel with a thickness of from 0.2 microns and 2.5 microns as more fully disclosed in U.S. Pat. No. 5,780,172.

When the coated article is heated, the tin reacts with copper, either from the substrate or the barrier layer, to form a copper tin intermetallic. A coefficient of friction, derived from the resistive force necessary to slide a coated article against a similarly coated article under a normal force, is preferably as low as possible to assist connector insertion. The coefficient of friction may be recorded as R/N, resistive force/normal force. Preferably, R/N is less than 0.4, more preferably less than 0.3, and most preferably less than 0.2.

When the zinc layer is between about 10 and 35 angstroms, and preferably between about 12 and 20 angstroms, R/N values of less than 0.3 are achieved following reflow of the tin base coating layer. When the article is to be heat aged at a time and temperature effective to convert all free tin (where free tin is defined as tin that is not alloyed with another metal) into a copper tin intermetallic, a suitable thickness range for the zinc is between about 8 and 65 angstroms to maintain a low R/N and a low contact resistance. Exemplary heat age profiles for a 50 microinch thick tin coating layer include either 7 days at 150° C. or 175° C. for 11 hours. Both heating profiles may be conducted in air or any other suitable atmosphere.

Optionally, the tin coating includes compounds that influence the properties of the tin coating layer. For example, a uniformly dispersed polymer such as polyimide, polyamide, and polytetrafluoroethylene ("TEFLON" is a trademark of DuPont Corporation of Wilmington, Del.) reduces friction without significantly increasing contact resistance. The polymer is added as particulate that ranges in size from about 0.5 microns to 3 microns.

Other suitable additions to the tin layer include silicon carbide, aluminum oxide, tungsten carbide, molybdenum disulfide, carbon black and graphite. Composite coatings are more fully disclosed in U.S. Pat. No. 5,028,492 by Guenin that is incorporated by reference in its entirety herein.

The anti-tarnish layer 18 is then applied into the tin coating 16 as described above.

The advantages of the invention will be better understood by the Examples that follows.

EXAMPLES

Example 1

Table 1 shows results of dipping an article with a tin coating into a chemical solution and then reflowing the surface of the tin coating.

A copper alloy, C194 alloy substrate (having a nominal composition of 2.1%–2.6% Fe, 0.05%–0.20% Zn, 0.015%–0.15% P and the balance copper and inevitable impurities) was electrocleaned in an aqueous alkaline solution having a concentration of about 30 g/l of sodium hydroxide for approximately 40 seconds at a current density of about 30 mA/cm$^2$.

The substrate was then rinsed in deionized water and a tin coating was deposited utilizing electroplating in an acidic sulfate solution having between 30 g/l and 50 g/l tin at an electric current density of about 30 mA/cm$^2$ for about 55 seconds to obtain a layer of tin about 50 microinches thick on the substrate.

The substrate was rinsed again in deionized water, and then dipped into an aqueous solution of zinc chloride having a zinc ion content of between 0.1 g/l–5.0 g/l, as specified in Table 1. It should also be noted that one of the additional benefits of the zinc chloride dip is to brighten the surface of the substrate during reflow, a cosmetically appealing result.

After dipping, the substrate was dried either in air or in a furnace, but not rinsed, leaving a residual film of zinc chloride on the tin coating. This residual film on the tin coating had a concentration of zinc chloride of between about 0.01% and 1.0% and the residual film thickness was between about 5 Angstroms to about 2000 Angstroms thick.

The substrate was then exposed to heat in an air atmosphere such that the tin melted and the tin surface reflowed. During this reflow, the residual zinc alloyed with the tin.

As can be seen from Table 1, the concentrations of the zinc chloride ($ZnCl_2$) solutions are 0.1 g/l, 0.5 g/l, 1 g/l and 5 g/l.

TABLE 1

| Time (sec) at 350° C. | Standard | 0.1 g/l $ZnCl_2$ | 0.5 g/l $Zn/Cl_2$ | 1 g/l $ZnCl_2$ | 5 g/l $ZnCl_2$ |
|---|---|---|---|---|---|
| 5 | bright | bright | bright | bright | bright |
| 15 | tarnished | bright | bright | bright | bright |
| 25 | tarnished | bright | bright | lightly tarnished | lightly tarnished |
| 35 | tarnished | bright | bright | lightly tarnished | lightly tarnished |
| 120 | — | lightly tarnished | lightly tarnished | — | — |

Table 1, shows qualitative results of samples having a composite tin and zinc coating and samples with a "standard" coating, which was a tin coating without the addition of zinc. The composite coatings were produced by immersing tin coated substrates in aqueous zinc chloride solutions having concentrations from 0.1 g/l to 5 g/l. The samples were all exposed to a hot plate at 350° C. to accelerate the tarnishing of the coatings. The time of exposure varied from 5 seconds to 120 seconds. After the particular exposure time elapsed the samples were removed from the heat and examined. The "bright" finishes were the most reflective, and did not show any yellowing or discoloration. The "lightly tarnished" finishes were not as reflective as the bright finishes and showed very slight discoloration in the coating. The "tarnished" finishes were yellow and/or light brown in color.

Example 2

Figure 3:
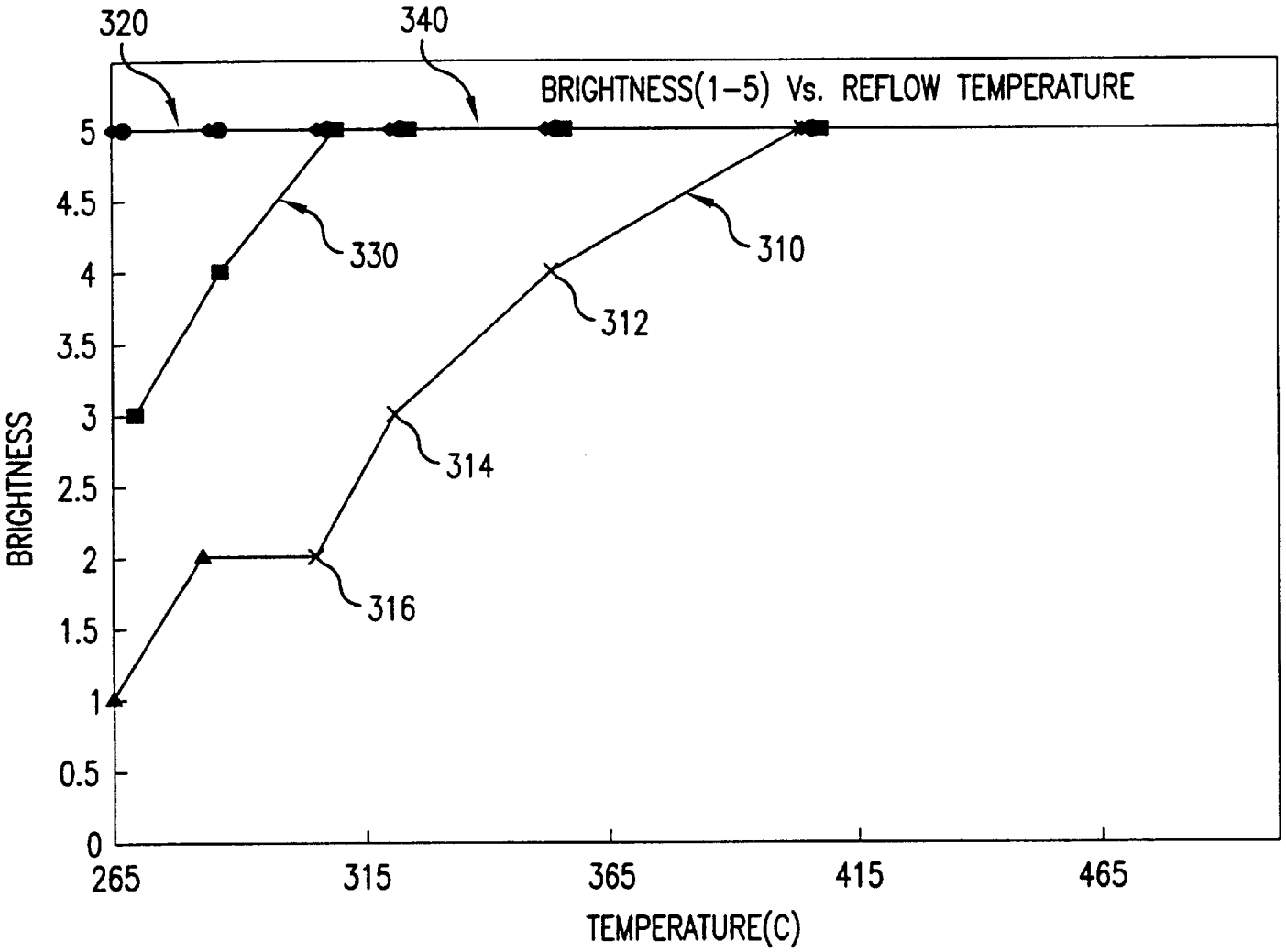
FIG. 3 graphically illustrates the reflow brightening temperatures as a function of processing.

FIG. 3 is a chart of experimental data tabulated in Table 2 that shows the effects of immersing the tin coated substrate in an anti-tarnish agent of the invention. Referring to both Table 2 and FIG. 3, reference line 310 refers to Sample A, reference line 320 refers to Sample B, reference line 330 refers to Sample C and reference line 340 refers to Sample D of the invention.

The samples were produced using tin coated copper alloy, C521 (nominal composition of 92% copper and 8% tin) substrates, which were dipped in an aqueous solution of zinc chloride having a zinc ion content of 0.5 g/l. A barrier layer consisting of 10 microinches of copper and 10 microinches of nickel was disposed between the substrate and the tin coating for Samples A and B; no barrier layer was utilized with Samples C and D. Samples B and D were then treated with an anti-tarnish agent as described in the present invention. One member of each of Samples A–D was then heated to a temperature as specified in Table 2 and retained at temperature for two seconds in an air atmosphere. After heating, the finish of each sample was visually examined and assigned a number. A number "5" was a bright finish and a number "1" was a dull, cloudy finish.

TABLE 2

| | Brightness scaled 1–5<br>5 = extremely bright, zero clouds<br>3 = semi bright<br>1 = dull all clouds | | | |
|---|---|---|---|---|
| Temp (C.) | A | B | C | D |
| 265 | 1 | 5 | 3 | 5 |
| 282 | 2 | 5 | 4 | 5 |
| 305 | 2 | 5 | 5 | 5 |
| 320 | 3 | 5 | 5 | 5 |
| 352 | 4 | 5 | 5 | 5 |
| 404 | 5 | 5 | 5 | 5 |

There is a minimum temperature at which reflow generates a bright finish. Surprisingly, the reflow temperature at which the samples having the anti-tarnish coatings had a bright finish was below 265° C., which is substantially lower the temperatures for a bright finish on Samples A and C. Control Sample A required a temperature of 405° C. and Sample C required a temperature in excess of 300° C. to achieve similar reflow brightening. A lower reflow temperature is beneficial because the reflow surface can be achieved in a furnace set at a particular temperature in less time. The article with the anti-tarnish agent does not have to be exposed to heat as long as articles without the anti-tarnish agent. This reduced time in a furnace increases efficiency of producing articles having a bright finish.

As a secondary benefit, at reflow temperatures between 300° C. and 350° C., Sample A exhibited significant yellowing. No yellowing at any temperature was detected in Sample B or Sample D at a temperature below 300° C. without compromising brightness.

Example 3

Copper alloy C197 (nominal composition of 0.3%–1.2% iron, 0.1%–0.4% phosphorous, 0.01%–0.2% magnesium and the balance copper) substrates were electrolytically coated with (nominally) 50 microinches of tin. A zinc layer was then electrolytically deposited on the tin coating from a zinc chloride containing electrolyte. The samples were aged at 150° C. for either seven or ten days as specified in Tables 3 and 4 and the contact resistance then determined.

TABLE 3

Contact Resistance in milliohms
Heat Aged 150° C. for 7 days
10 sites tested, contact force = 100 grams

| Amps (for Zn (deposition) | Zn nominal plated thickness (angstroms) | Average contact resistance | Maximum contact resistance | Minimum contact resistance |
|---|---|---|---|---|
| 0 | 0 | 19.3 | 52.8 | 5.74 |
| 2 | 8.3 | 3.37 | 4.76 | 2.37 |
| 4 | 16.5 | 2.26 | 2.82 | 1.93 |
| 6 | 24.8 | 1.75 | 2.31 | 1.33 |
| 8 | 31.0 | 2.91 | 8.69 | 1.79 |
| 10 | 41.3 | 3.85 | 5.29 | 2.23 |

TABLE 4

Contact Resistance in milliohms
Heat Aged 150° C. for 10 days
10 sites tested, contact force = 100 grams

| Amps (for Zn (deposition) | Zn nominal plated thickness (angstroms) | Average contact resistance | Maximum contact resistance | Minimum contact resistance |
|---|---|---|---|---|
| 0 | 0 | 18.6 | 38.9 | 6.95 |
| 2 | 8.3 | 9.24 | 13.7 | 5.35 |
| 4 | 16.5 | 3.15 | 7.35 | 1.79 |
| 6 | 24.8 | 3.24 | 6.29 | 2.37 |
| 8 | 31.0 | 3.15 | 4.37 | 1.92 |
| 10 | 41.3 | 4.50 | 6.60 | 2.89 |

Tables 3 and 4 illustrate that contact resistance degrades less rapidly when a zinc layer is deposited on the surface of the tin coating layer and that a relatively low thickness, on the order of 8.3–16.5 angstroms is effective to maintain a contact resistance of less than 10 milliohms after heat aging.

R/N was calculated by forming a hemispherical tin projectile on a first substrate (nominal diameter 3.2 millimeter) and a tin coated flat second substrate and coating both with a desired thickness of zinc. After heat aging for 10 days at 150° C., a 250 gram weight or 750 gram weight (normal force, N) was applied. For both normal force weights, the first and second substrates included a multilayer barrier (10 microinches on nickel contacting copper alloy followed by 10 microinches of copper contacting tin). The force required to move the first substrate across the surface of the second substrate (resistive force, R) was then determined and R/N calculated, as recorded in Table 5.

TABLE 5

| Amps (for Zn deposition) | Zn nominal plating thickness (angstroms) | R/N N = 250 gm Ni/Cu barrier | R/N N = 750 gm Ni/Cu barrier |
|---|---|---|---|
| Standard | 0 | 0.45 | 0.34 |
| 0 | 0 | 0.43 | 0.27 |
| 3 | 12.4 | 0.29 | 0.27 |

TABLE 5-continued

| Amps (for Zn deposition) | Zn nominal plating thickness (angstroms) | R/N N = 250 gm Ni/Cu barrier | R/N N = 750 gm Ni/Cu barrier |
|---|---|---|---|
| 4 | 16.5 | 0.42 | 0.27 |
| 12 | 49.5 | 0.37 | 0.25 |

Standard = tin coating layer not exposed to zinc.
0 = tin coating layer immersed in zinc chloride electrolyte without addition of current.
R/N values for Standard and 4 amps are average of two runs at each normal force, 0, 3 and 12 amps are average of four runs at each normal force.

The conversion of substantially all of the free tin to a non-oxidized tin-containing intermetallic minimizes the R/N value. It is believed that an electrical or electronic article that is coated with a tin containing layer followed by a thin zinc layer and then heat aged to convert substantially all of the free tin to a non-oxidized tin-containing intermetallic will have both a low R/N value and a low contact resistance. For a tin containing layer having a thickness of about 50 microinches, exemplary heat aging profiles are either about 3 days at 150° C. or 11 hours at 175° C.

At all zinc thicknesses between about 5 angstroms and 50 angstroms, the reflectivity of a reflowed sample was in excess of 10 inches. This compares favorably with a reflectivity of about 5 inches for a reflowed sample lacking a zinc layer. Comparable results (in excess of 10 inch reflectivity) was also obtained by non-electrolytic immersion of the tin coated sample into a zinc chloride electrolyte.

As illustrated in Table 6, a zinc coating also improves solderability. Solderability was determined by dipping a tin coated sample into molten solder for 5 seconds and then withdrawing the sample and determining the percentage of sample wet by the solder. In accordance with Military Standard Mil-Std-883E, at least 95% wetting should be obtained. The following scale was employed:

| | |
|---|---|
| Class I | 100% wetting |
| Class II | 95%–99.9% wetting |
| Class III | 50%–95% wetting |
| Class IV | less than 50% wetting |
| Class V | no wetting |

TABLE 6

| Sample condition | Standard reflow, No zinc layer | Standard reflow Zinc layer (12 and 33 angstroms) |
|---|---|---|
| As received | Class I–II | Class I |
| Steam aged | Class II–III | Class I–II |

Steam aging entailed exposure of the sample to steam at 92° C. for 8 hours, 100% relative humidity, 1 atmosphere.

The zinc coated reflow samples showed no signs of yellowing after steam aging while samples without a zinc layer all yellowed to some extent after steam aging.

While zinc, indium and phosphorous have been described as materials that reduce oxidation of tin, it should be appreciated that any element that has a more negative free energy of oxide formation than tin should also reduce the formation of oxide on a tin coating. Examples of such elements include potassium (K), sodium (Na), chromium (Cr), manganese (Mn), vanadium (V), boron (B), silicon (Si), thallium (Ti), cerium (Ce), magnesium (Mg), aluminum (Al) and calcium (Ca).

It is apparent that there has been provided in accordance with this invention a method for providing a tin coating that resists oxidation. While this invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method for reducing the coefficient of friction of an article having a tin or tin base alloy layer coating a copper or a copper base alloy substrate, comprising the steps of:

forming said tin or tin base alloy layer to a thickness of between 15 and 200 microinches; and coating said tin or tin base alloy layer with a zinc containing layer, said zinc containing layer having a thickness in excess of 5 angstroms.

2. The method of claim 1 wherein said zinc containing layer is electrolytically deposited and has a thickness of between 5 and 50 angstroms.

3. The method of claim 2 wherein subsequent to said zinc containing layer coating step, said article is heated to a temperature for a period of time wherein said temperature and time are effective to convert substantially all free tin into a non-oxidized tin-containing intermetallic.

4. The method of claim 3 wherein said article is to a temperature in excess of 150° C., but below the reflow temperature of said tin or tin base alloy layer.

5. A heat aged article having electrical or electronic applications, comprising:

a copper or copper base alloy substrate;

a tin containing layer overlying said substrate, wherein substantially all tin contained within said tin containing layer is in the form of a non-oxidized tin containing intermetallic; and a zinc containing layer overlying said tin containing layer, wherein, the contact resistance of said article is less than 10 milliohms following heat aging in air at a temperature of 150° C. for at least seven days.

6. The article of claim 5 wherein said intermetallic is predominately a copper/tin intermetallic.

7. The article of claim 6 formed into an electrical connector.

* * * * *